United States Patent [19]

McMahon

[11] 3,955,491

[45] May 11, 1976

[54] AUTOMOTIVE TIRE STACKING AND STRAPPING MACHINE

[75] Inventor: Michael J. McMahon, Palatine, Ill.

[73] Assignee: Signode Corporation, Glenview, Ill.

[22] Filed: Mar. 4, 1975

[21] Appl. No.: 555,142

[52] U.S. Cl. ..... 100/7; 53/198 R; 100/2; 100/12; 100/14; 100/26; 214/6 BA

[51] Int. Cl.[2] ..... B65B 13/04; B65B 13/18

[58] Field of Search ..... 100/8, 7, 12, 14, 26, 100/2, 33 PB; 214/6 BA; 53/198 R

[56] References Cited

UNITED STATES PATENTS

| | | | |
|---|---|---|---|
| 1,507,376 | 9/1924 | Hintz | 100/12 X |
| 2,917,991 | 12/1959 | Segur | 100/7 |
| 3,057,486 | 10/1962 | Moulthrop | 214/6 BA |
| 3,092,266 | 6/1963 | Koning | 214/6 BA |
| 3,182,586 | 5/1965 | Armington | 100/14 X |
| 3,195,444 | 7/1965 | McLean | 100/12 X |
| 3,377,944 | 4/1968 | Hill | 100/26 X |
| 3,388,816 | 6/1968 | Lueddeke | 214/6 BA |
| 3,618,791 | 11/1971 | Potter | 214/6 BA |
| 3,659,695 | 5/1972 | Reese | 214/6 BA |
| 3,834,298 | 9/1974 | Paschal | 100/7 |

*Primary Examiner*—Billy J. Wilhite

[57] ABSTRACT

An automobile tire stacking and strapping machine embodying a stacking station where a predetermined number of tires are upstacked by successive application thereof to the bottom of a stack undergoing erection, and the completed stack is transferred bodily to a strapping station and deposited therein. At the strapping station, lengths of strapping material are passed endwise through the eye of the stack, brought around the outer side thereof in overlapping relationship to provide closed loops, the loops tensioned and the loop overlaps sealed together, the excess strapping severed from the loops, and the thus strapped stack pushed from the machine to a discharge area. The strapping operation is conducted on each stack at the strapping station while a preceding stack of tires is undergoing erection at the stacking station.

11 Claims, 9 Drawing Figures

AUTOMOTIVE TIRE STACKING AND STRAPPING MACHINE

The present invention relates to an automobile tire stacking and strapping machine and has particular reference to such a machine wherein tire stacking operations are performed at a stacking area or station so as to produce a vertically disposed stack of horizontally positioned superimposed tires arranged in coaxial relationship and containing a predetermined number of such tires, after which the thus established stack is shifted bodily as a unit from the stacking station to an adjacent strapping area or station where the stacked tires are operated upon by one or more substantially conventional commercial strapping machine heads to feed lengths of flexible strapping axially through the eye of the stack and from thence around the outer peripheries of the tires to produce closed loops of strapping which are then tensioned and sealed so as to bind the peripheral regions of the tires together at circumferentially spaced regions around the stack.

Heretofore, insofar as tire stacking operations preparatory to strapping are concerned, it has been the practice to erect the stack by placing the tires, one upon another in building block fashion until the desired stack height has been attained. This method of stacking is invariably followed where the stacking operations are performed entirely by hand. Where automatic stacking machines are concerned, and in order to obviate the necessity of feeding tires to the stack at progressively higher levels, it has been proposed that successive tires be fed to the stack at a common level and that as each tire is positioned on the top of the preceding tire in the stack, the stack becomes lowered by one tire width, the stack thus being indexed in a downward direction progressively each time a tire is added to the stack. Such a method is commonly referred to as "down-stacking."

Such down-stacking procedure is possessed of certain limitations, principal among which is the necessity for providing costly stack indexing and timing mechanism for lowering the stack each time a tire is placed thereon. Furthermore, where down-stacking is concerned, the feeding of tires to the stack must take place at a considerable elevation above floor level to make room for the progressively descending stack or, alternatively, a stack pit must be provided to accommodate the stack and, when this is done, the matter of lifting the completed and unstrapped stacks from the pit and otherwise handling them to conduct the stacks and bring them into position at a strapping location presents considerable difficulty.

The present invention is designed to overcome the abovenoted limitations that are attendant upon the construction and use of conventional or present day automatic tire stacking and strapping machines and, toward this end, the invention contemplates the provision of a novel apparatus embodying a stacking station into which successive tires may be fed substantially at floor level and wherein each tire, as it is received in such station is immediately raised vertically by a distance slightly greater than one tire width or thickness and held or clamped in such raised position so that the next succeeding tire may be received in position immediately below and in centered relationship with respect to the first tire. Before reception of the second tire, the lifting means is lowered to afford the necessary clearance and when the second tire is centered within the now commenced stack, the lifting means is again operated to raise both tires vertically, one upon the other. The operation is repeated until the predetermined number of tires have been thus placed in the stack. At such time as the lifting means rises to elevate a tire, and consequently the stack undergoing erection, the holding or clamping means for the previously received tires in the stack is momentarily released to afford a clearance for entry of the new tire into the stack, and then is again engaged to hold the stack with its added tire elevated. When the predetermined number of tires have thus been up-stacked, the holding means remains engaged and a carriage, which embodies such clamping means, is shifted bodily toward a strapping station to bring the stacked, but yet unstrapped, tires into position above a turntable at the strapping station. The clamping means is then released, thus allowing the stack to be deposited in a vertical position upon such turntable and the carriage, together with its clamping means is returned to the stacking station for commencement of the erection of the next stack.

As soon as the stack has been deposited upon the turntable, a pair of conventional strapping heads having strap feeding, tensioning, sealing and severing instrumentalities associated therewith, move radially inwardly against the opposite sides of the stack and cause lengths of strapping material to be fed through a series of registering strap chutes or guides endwise upwardly past the outer sides of the stack at diametrically disposed regions and then radially inwardly and downwardly through the eye of the stack and from thence radially outwardly and upwardly back to the strapping heads where overlapping portions of the thus formed strap loop are sealed together after the necessary strap tensioning operations have been completed. Thereafter, the strapping heads are momentarily retracted, the turntable rotated through an angle of 90°, and the strapping heads are again brought into engagement with the stack so that two additional strap loops are similarly applied to the stack. The completely stacked tires are thus held in their strapped condition by four tensioned strap loops which are disposed 90° apart.

During such strapping operations, the instrumentalities at the stacking station are maintained in operation to produce the next succeeding stack and, when this latter stack is shifted to the strapping station as previously set forth, a pair of abutments on the clamping carriage engages the strapped stack and pushes it from the strapping station to a region of discharge. The operation is repetitious.

The provision of a stacking and strapping machine such as has briefly been outlined above constitutes the principal object of the present invention.

Apart from the broad concept of the invention, the present invention is possessed of numerous ancillary features of novelty as, for example, the provision o antifriction rollers for conducting the individual tire into the stacking station, and similar antifriction roller which are associated with the turntable and which be come properly oriented for ease of shifting motion o the tire stacks from the turntable at the end of eacl strapping cycle after the turntable has been rotated fo application of the last two straps to the stack, as well a the provision of a series of fixed and movable stra chutes which move into operative loop-forming rela tionship at such time as the two strapping heads mov against the stacks for strapping purposes.

The provision of a tire stacking and strapping machine which is relatively simple in its construction as compared with conventional machines, whether the latter be of the up-stacking or the down-stacking type, and which may therefore be manufactured at a relatively low cost; and on which to a certain extent employs commercially available actuating components, thereby further constributing to a low cost factor; one which is comprised of a minimum number of parts, particularly moving parts, and which therefore is unlikely to get out of order; one which is rugged and durable and which, therefore, will withstand rough usage; one which is capable of ease of assembly and disassembly for purposes of inspection of parts, replacement or repair thereof; one which requires no particular degree of skill for its operation, one which requires no actual manual handling of the individual tires; one which is smooth and relatively silent in its operation, and one which, otherwise, is well adapted to perform the services required of it, are further desirable features which have been borne in mind in the production and development of the present invention.

Numerous objects and advantages of this invention, not at this time enumerated, will become readily apparent as the nature of the invention is better understood.

In the accompanying seven sheets of drawings forming a part of this specification, one illustrative embodiment of the invention has been illustrated.

In these drawings:

FIG. 1 is a left front side perspective view of a tire stacking and strapping machine embodying the principles of the present invention;

FIG. 2. is a fragmentary perspective view, similar to FIG. 1 with certain parts broken away in the interests of clarity and showing a single tire in position at the stacking station preparatory to the building up or erection of a first stack, showing a completed but unstrapped second stack of tires at the strapping station preparatory to strapping thereof and showing a third completely strapped stack which has been pushed from the machine;

Figure 3:
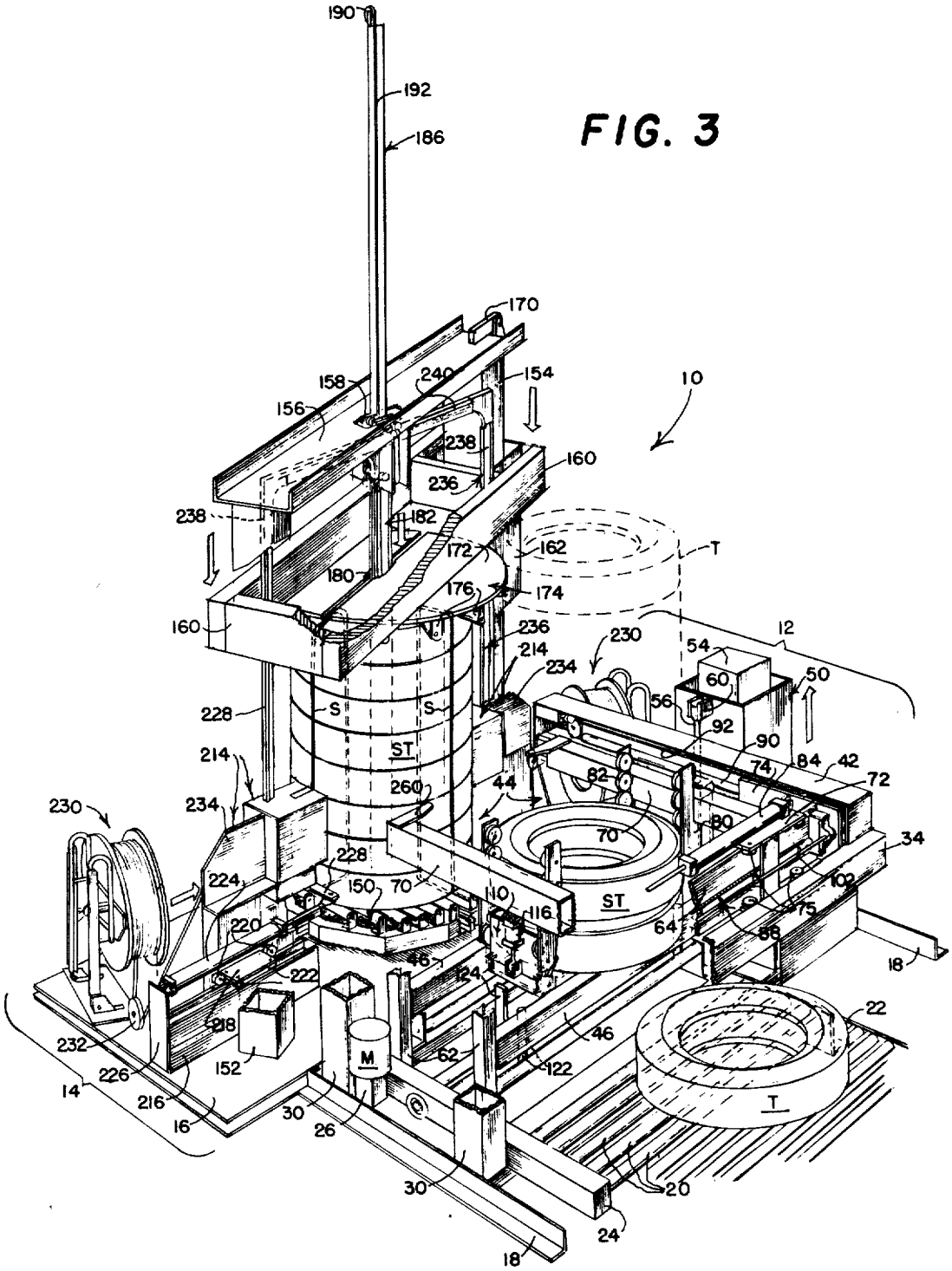
FIG. 3 is a fragmentary perspective view, similar to FIGS. 1 and 2, showing a second tire positioned in the stack at the stacking station, and also showing a previously completed tire stack at the stacking station completely strapped, certain parts being broken away in the interests of clarity.
Figures 4, 4A:
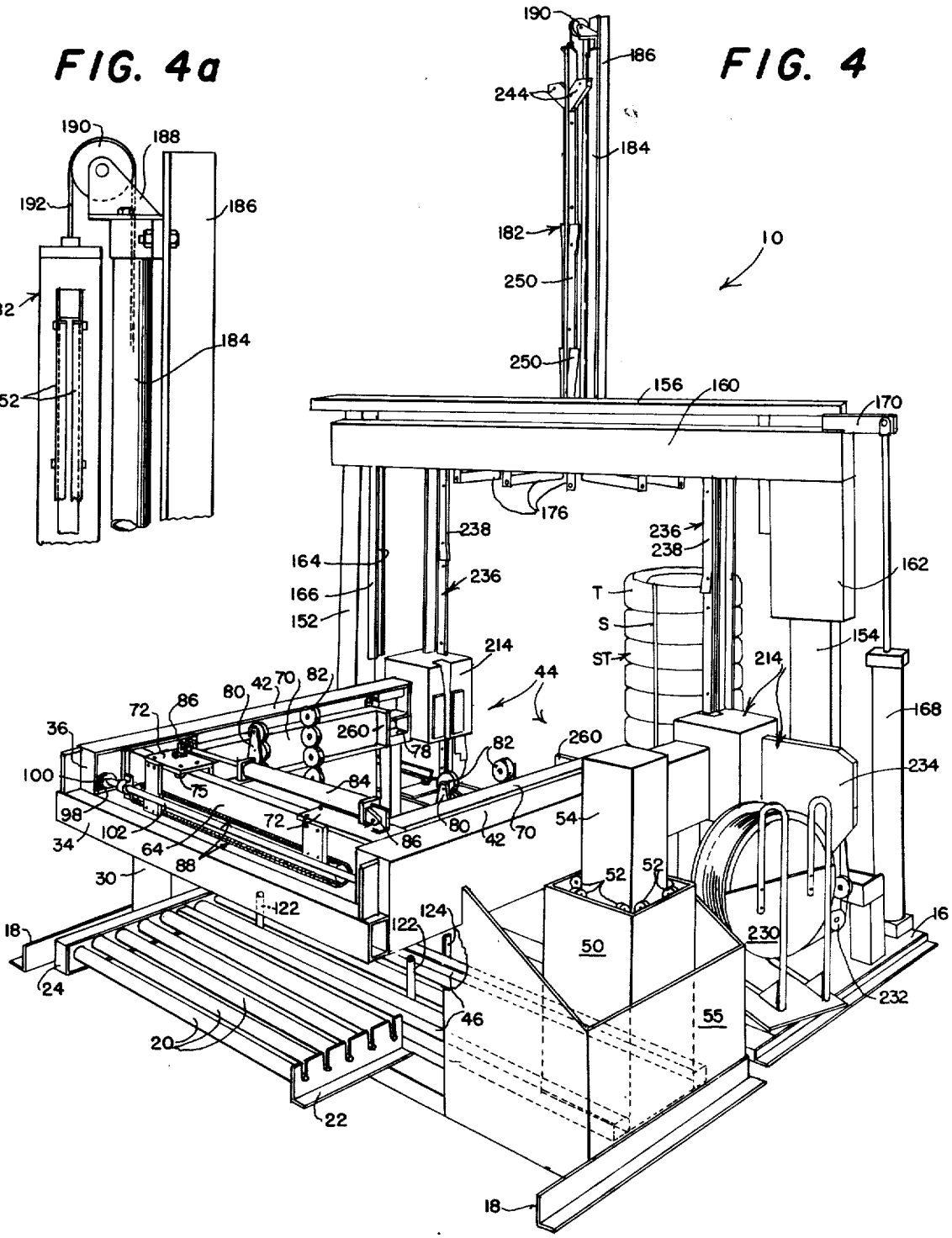
FIG. 4 is a front right side perspective view of the tire stacking and strapping machine, devoid of tires at either the stacking station or the strapping station, but showing a completed strapped tire stack which has been pushed from the machine onto a discharge conveyor.
Figure 5:
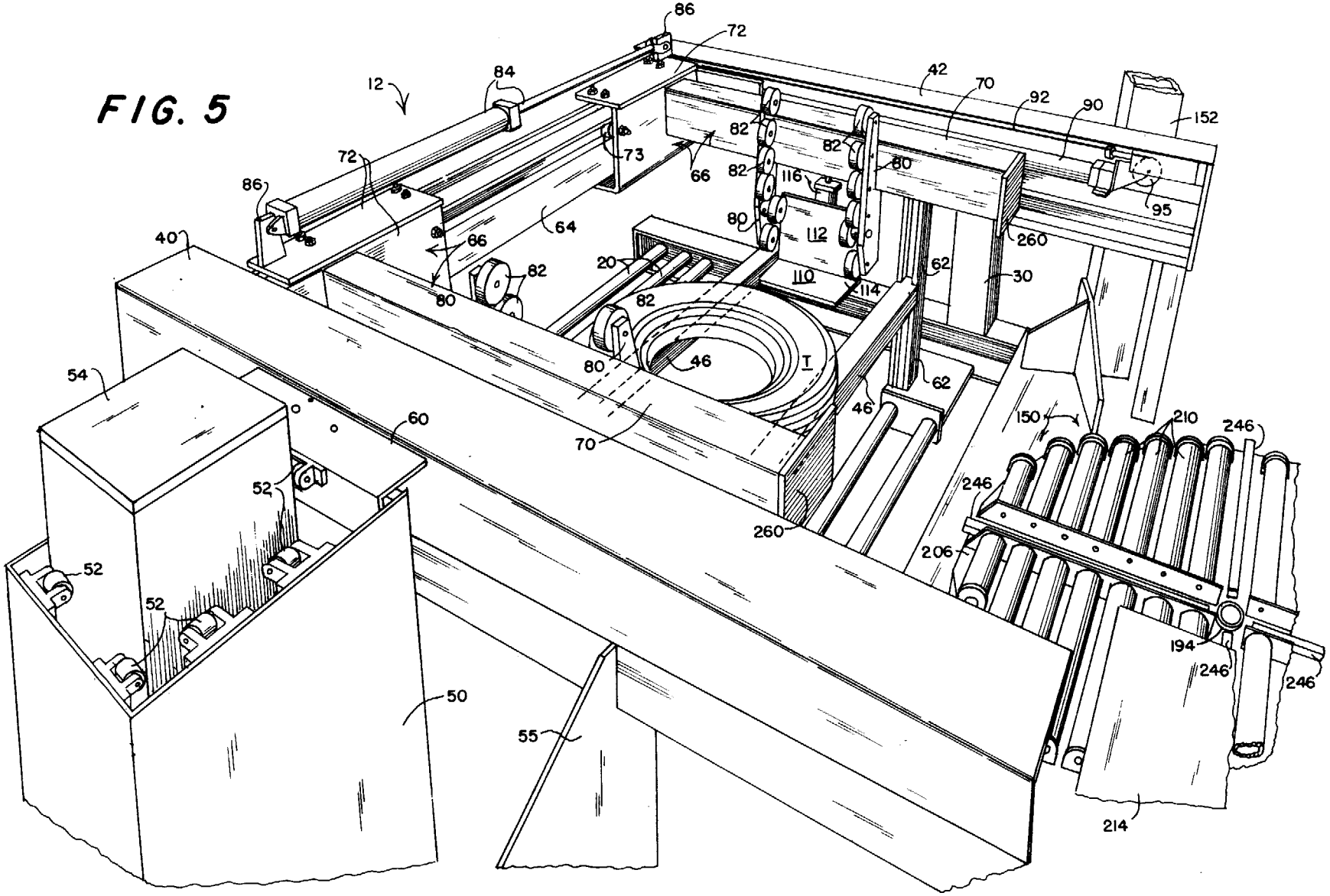
Figure 6:
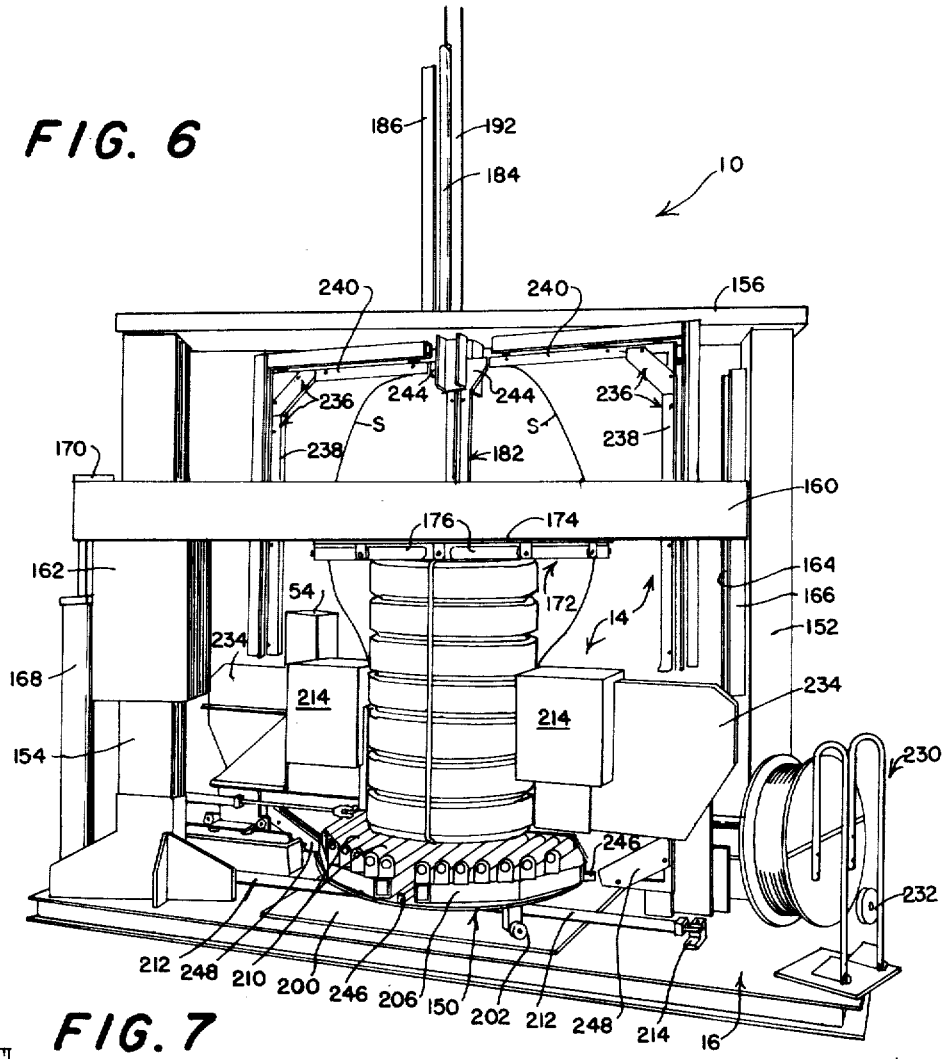
Figure 7:
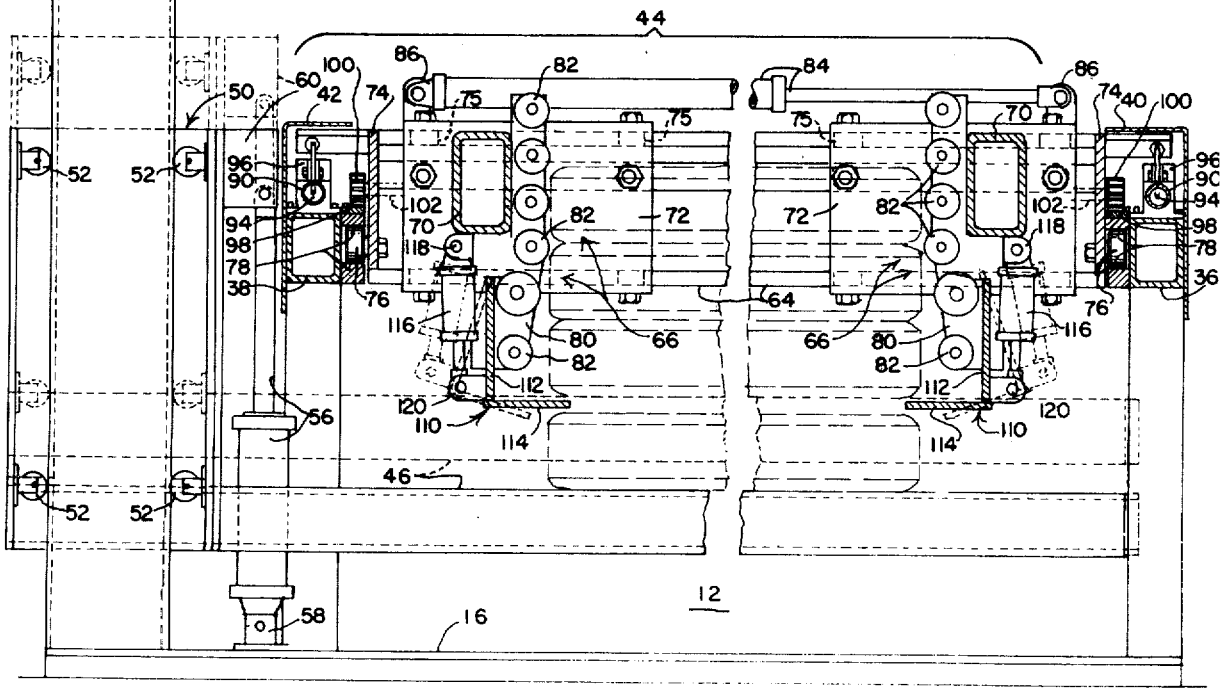
Figure 8:
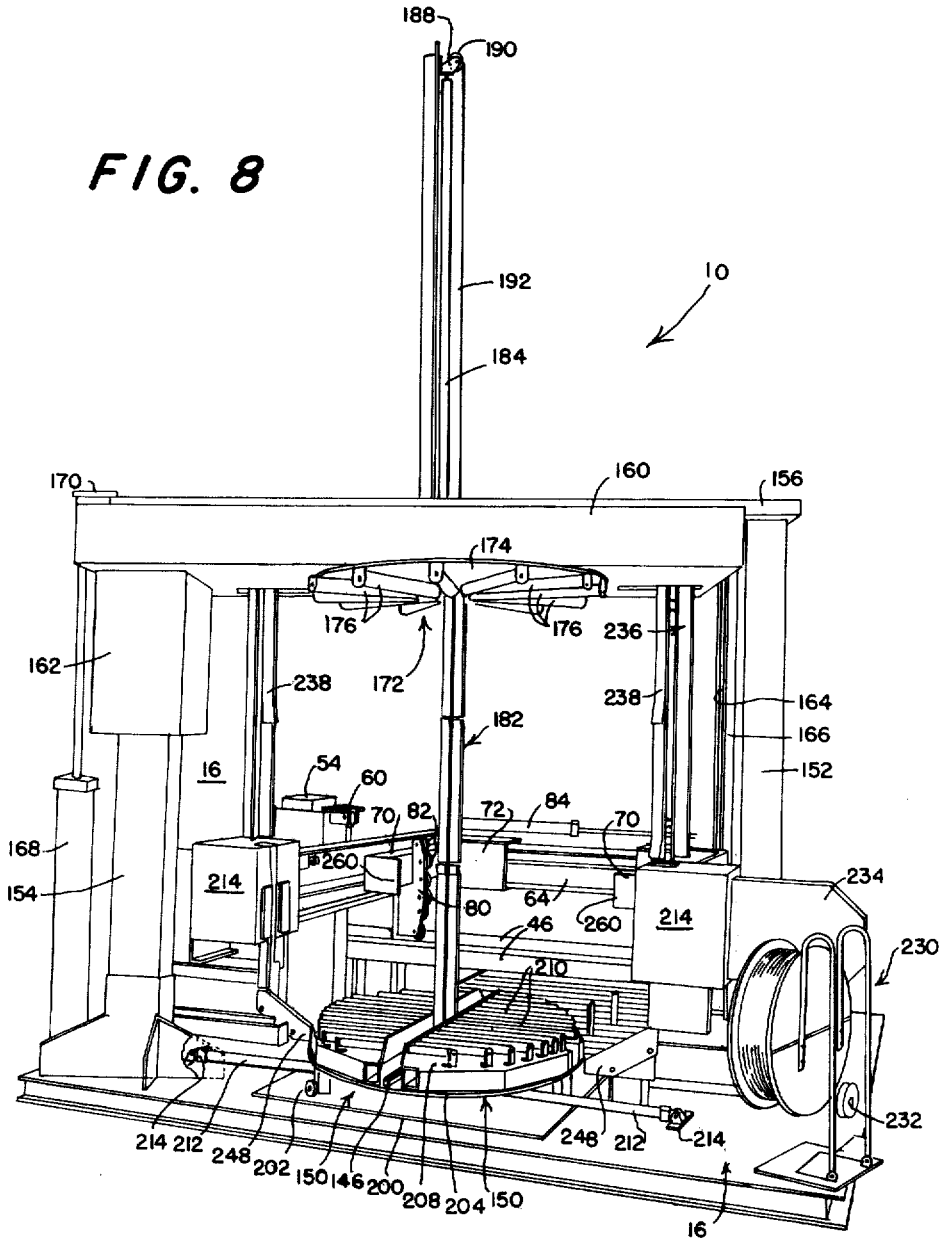

FIG. 4*a* is an enlarged fragmentary side elevational view of the extreme upper portion of the structure shown in FIG. 4;

FIG. 5 is a fragmentary right side elevational view of the stacking instrumentalities at the stacking station and showing a single tire in position thereat, such tire being elevated to a stacking level preparatory to erection of a complete stack;

FIG. 6 is a rear left perspective view of the machine, showing a partially strapped stack of tires at the strapping station and illustrating schematically the manner in which strapping operations on the stack are carried out;

FIG. 7 is an enlarged fragmentary sectional view taken substantially on the vertical plane indicated by the line 7—7 of FIG. 3 and in the direction of the arrows; and FIG. 8 is a rear perspective view, similar to FIG. 5, showing the tire stack removed from the stack-supporting turntable at the strapping station, the vertically shiftable strap chute section projected to its lowermost operative position, and showing the turntable indexed throughout an angle of 90° preparatory to ejection of a strapped tire stack from the machine.

Figure 1:
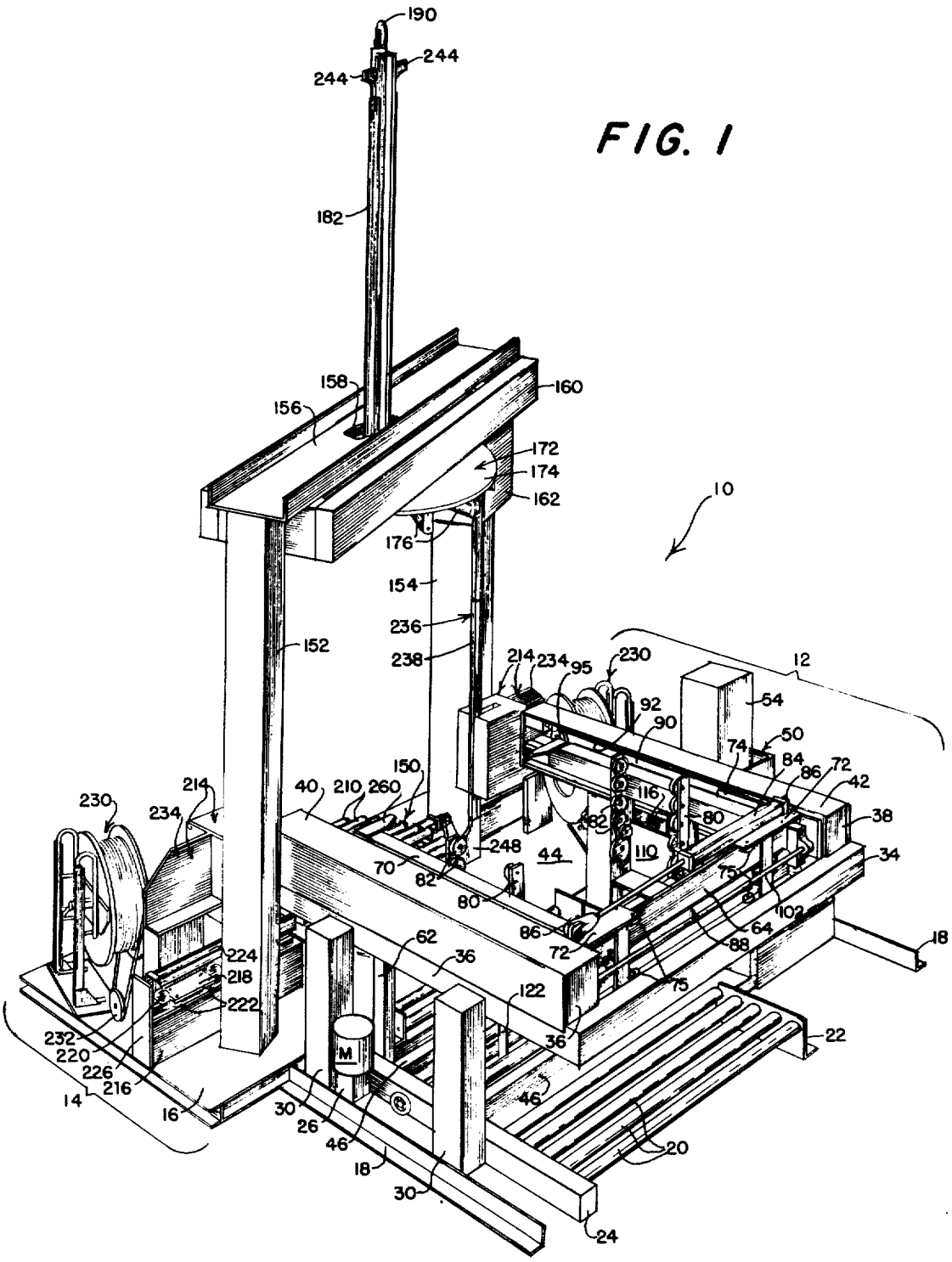

Referring now to the drawings in detail, and in particular to FIG. 1, a tire stacking and strapping machine embodying the principles of the present invention is designated in its entirety by the reference numeral 10, the machine being shown in its free or normal condition preparatory to the introduction of tires thereinto for stacking and strapping purposes. Briefly, and at the outset, it is pointed out that the machine embodies a framework which, roughly, defines a forward stacking area region or station which in several of the views has been designated by brackets 12, and a rearward strapping area, region or station which similarly has been designated by brackets 14.

Although there has been illustrated herein a fairly detailed disclosure of an operative tire stacking and strapping machine, it is not deemed necessary to describe in detail certain of the illustrated components such as roller bearings, frame-reinforcing webs, flanges or gusset plates, guard shields and other instrumentalities or devices which bear only an incidental relationship to the present invention. Stated otherwise, a relatively brief description of the essential components such as various bodily movable or shiftable carriage assemblies, together with a description of their functions and of their associated movable or stationary parts by means of which they are caused to function, will be set forth herein. Furthermore, although the illustrated machine is capable of fully automatic operation beginning with the individual feeding of successive automotive tires rearwardly on a series of live rolls into the stacking station 12 and ending with the discharge of fully stacked and strapped tires or bundles rearwardly from the strapping station 14, the control circuitry by means of which fully automatic operation of the machine has not been disclosed herein and only a few essential elements thereof such as pneumatic motors, cylinders and the like, together with certain limit switch and other electrical devices appear in the drawings while a brief reference to their functions is made herein.

Figure 2:
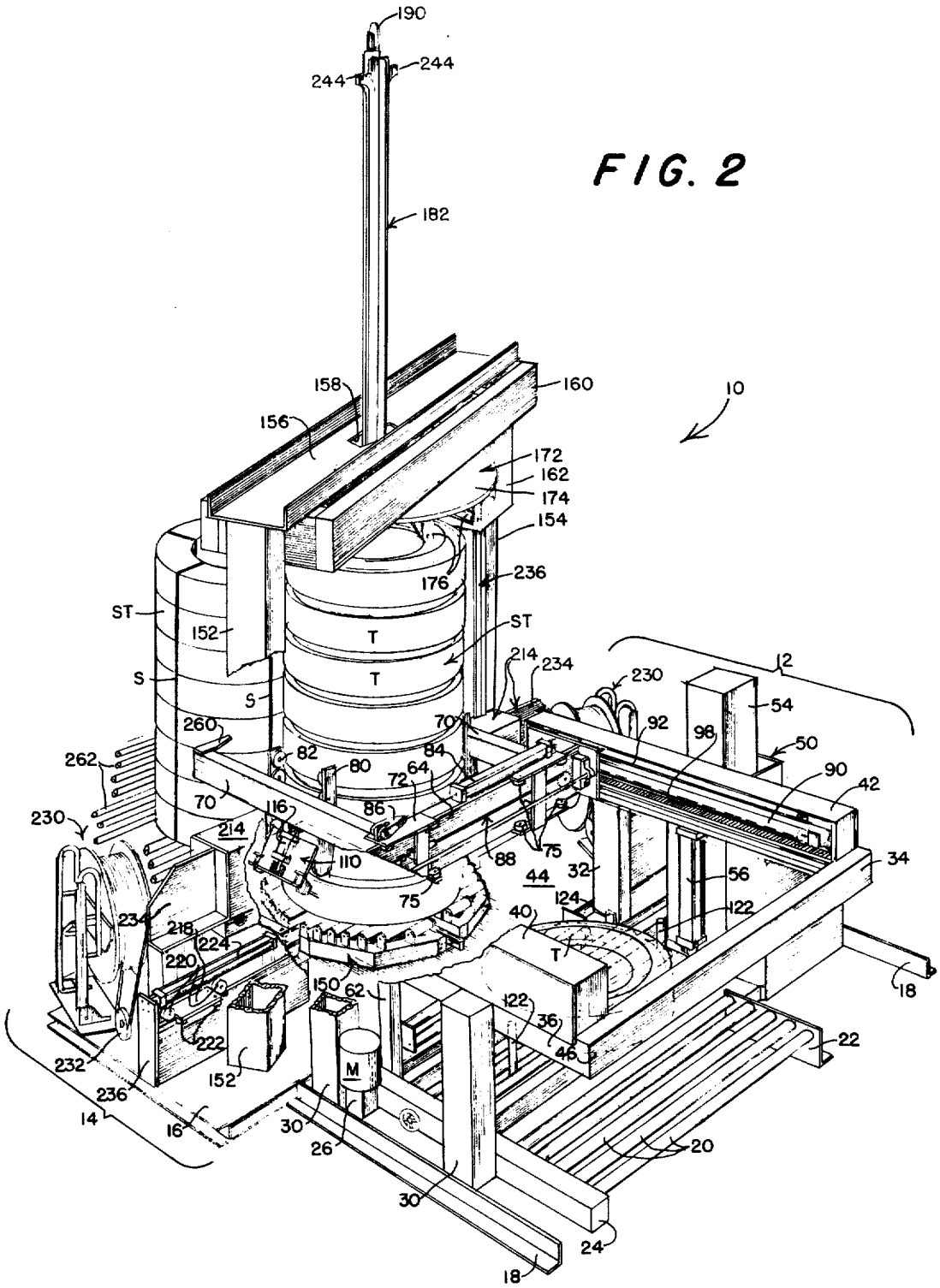

Still referring to FIG. 1, and additionally to FIGS. 2 and 3, the tire stacking and strapping machine 10 involves in its general organization a base framework including a rectangular deck or floor plate 16 on which substantially all of the strapping instrumentalities at the strapping station 14 are supported. A pair of angle bars 18 project forwardly from the front end of the deck 16 at the floor level and adjacent the opposite sides of the machine. Immediately forwardly of the stacking station 12, a series of transversely extending live rolls 20 are provided for the purpose of introducing successive tires such as the tire T shown in FIG. 3 rearwardly and into the stacking station 12 for stacking purposes in a manner that will be made clear presently. The live rolls have their right hand ends rotatably journalled in a third angle bar 22 which projects forwardly from the deck 16 while the left hand ends of such live rolls are powered by mechanism (not shown) which is contained within a hollow tubular casing structure 24 which also projects forwardly at floor level from the forward edge of the deck 16. The specific means whereby the live rolls 20 are driven may be of any conventional type such as chain and sprocket mechanisms, rack and pinion devices or the like which are housed within the casing structure 24 and it will be understood that such means may be operatively connected to and driven by a suitable electric motor M supported on a pedestal 26 which may be welded or otherwise secured to the casing structure 24 and the adjacent angle bar 18. Additional rolls extend transversely across the strapping station 12 and establish a platform or support which receives thereon the tires which issue from the live rolls 20.

In the following description, reference to the right and left hand side of the machine 10 will be considered as looking rearwardly into the stacking station 12 from the front of the machine where the live rolls 20 are situated and, on this basis, a pair of relatively short upstanding frame-supporting posts 30 project upwardly on the left side of the machine in the vicinity of the strapping station 12 from between the members 18 and 24, while similar posts 32 project upwardly at the right side of the machine, such posts preferably being of tubular construction. The various posts 30 and 32 serve to support at their upper ends a fixed horizontal rectangular U-shaped frame including a front frame bar 34, a left side frame bar 36 and a right side frame bar 38 (see also FIG. 7). Supported on the frame bar 36 is a sheet metal shield 40 while a similar shield 42 is supported on the frame bar 38. It will be understood that the various elements 16, 18, 22, 24, 30, 32, 36, 38, 40 and 42 are all fixed elements of the basic machine framework.

Disposed within the confines of the horizontal U-shaped frame 34, 36, 38, is a longitudinally shiftable and transversely collapsible tire-clamping carriage assembly 44, the latter being shiftable in opposite directions bodily as a unit between the stacking station 12 as shown in FIGS. 1, 3 and 4, and the strapping station 14 as shown in FIG. 2, and also being collapsible and expansible between the tire-releasing position in which it is shown in FIGS. 1, 4, 5 and 8, and the tire-clamping position in which it is shown in FIG. 2, 3 and 6, all in a manner and for a purpose that will be made clear presently.

Positioned beneath the level of the tire-clamping assembly 44 and spanning substantially the entire transverse width of the stacking station 12 are a pair of spaced apart vertically shiftable tire-lifting bars or forks 46 (FIGS. 1, 2, 3, 5, 7 and 8), the function of which is to receive successive tires from the rolls 20 and raise them upwardly, one at a time, to a stacking level and into the confines of the tire-clamping carriage assembly 44, thus progressively building up a stack of tires, a partial stack of two tires being shown in FIG. 3 in full lines and a full stack of tires being shown in this view in dotted lines. The stack is thus built up by causing each freshly received tire at the stacking station to push a preceding tire upwardly within the tire-clamping carriage assembly 44 so that the stack is built up from the bottom of the stack instead of following the conventional method of tire stacking where each tire is placed upon the upper surface of a preceding tire and throughout this specification as well as in the appended claims, this method of adding tires to the bottom of the progressing stack will be referred to as an "up-stacking" operation. Such up-stacking of tires in the production of a tire stack which is subsequently to be strapped constitutes one of the principal features of the present invention.

As best shown in FIGS. 4, 5 and 7, the two lifting bars or forks 46 are horizontally disposed in cantilever fashion from the lower end of a vertically shiftable sleeve-like slide member 50 which is square in cross section and which, by means of a series of rollers 52, is tractionally shiftable vertically on a central supporting or guide post 54 which projects upwardly from the deck of floor plate 16. A protective shield 55 encompasses the slide member 50. A cylinder and plunger assembly 56 (see also FIGS. 2 and 3 and 7) which will hereinafter be referred to simply as the lift cylinder extends between a mounting bracket 58 on the deck plate 16 and an attachment bracket 60 on the upper end of the slide member 50 and functions to effect the vertical raising and lowering movements of the latter, and consequently of the tire-lifting forks 46. The distal ends of the cantilever lift forks 46 project into and are guided within vertical channels 62 (FIGS. 1, 5 and 7) which constitute portions of the machine framework.

Considering now the aforementioned expansible and contractible tire clamping carriage assembly 44, and referring particularly to FIGS. 1, 3, 5 and 7, this assembly involves in its general organization a transversely extending guide bar 64 which is slidable sidewise in the longitudinal direction of the machine and from which there project rearwardly a pair of substantially identical tire clamping units or components 66 (FIGS. 5 and 7). Because of the similarity between the two tire clamping components 66, a description of one of them will suffice for them both. These two components or units are shiftable in unison toward and away from each other along the guide bar 64 between inner tire-engaging stacking positions as shown in FIGS. 3 and 7 for example and remote tire-releasing positions are shown in FIGS. 1, 4 and 8 for example.

As best shown in FIGS. 1 and 5 the tire clamping carriage assembly 44 is generally in the form of a transversely collapsible U-shaped frame in which the guide bar 64 constitutes the forward base of the U while the legs of the U are in the form of tubular members or clamp bars 70 (FIGS. 1 to 4 inclusive, 7 and 8). The clamp bars 70 are supported in cantilever from respective slide members 72 (see particularly FIGS. 5 and 7) which are slidable toward and away from each other on the transverse guide bar 64 by means of vertical rollers 73 and horizontal rollers 75. The opposite ends of the transverse guide bar 64 are provided with rearwardly extending plates 74 which carry longitudinally spaced rollers 76 (FIG. 6) which travel in guideways 78 provided on the inner sides of the frame bars 36 and 38, thus preventing tilting of the guide bar 64 and consequently of the entire carriage 44 as a whole.

Normally, during the entire stacking operation, the carriage 44 remains at the stacking station 12 but it is capable of being shifted bodily as a unit rearwardly from the stacking station to the strapping station 14 at the completion of each stacking operation so that the entire stack of tires maybe brought into strapping position at such latter station, all in a manner that will be described in detail subsequently.

Still considering the details of the tire-clamping assembly or carriage 44, and referring particularly to FIGS. 1, 3 and 7, each of the clamp bars 70 has welded or otherwise secured thereto in the medial regions thereof a pair of depending spaced apart roller-supporting plates 80 each of which has mounted thereon a series of vertically spaced tire-engaging or guiding rollers 82. Although six such rollers have been shown associated with each plate 80, a greater or lesser number of such rollers may be employed if desired. As clearly shown in FIG. 7, the various rollers 82 overhang the peripheral edge of their associated plates 80 so that when the clamp bars 70 move inwardly toward each other, such rollers may effectively engage the peripheral regions of such tires as are undergoing stacking and center the same axially in the stack as the latter progresses in height.

As best shown in FIGS. 1, 5 and 7, movement of the slide members 72 toward and away from each other is effected under the control of a piston and cylinder assembly 84 which hereinafter will be referred to simply as the clamp cylinder, the opposite ends of such assembly being connected to suitable lugs 86 which are mounted on the slide members. In order to equalize the in and out movements of the members 72, and consequently of the clamp arms 70, a conventional chain and sprocket mechanism 88 may be employed, the chain having its upper and lower portions anchored to the two slide members 72 respectively.

Movement of the tire clamping carriage assembly 44 between the tire stacking station 12 and the stack strapping station 14 is effected under the control of a pair of cable cylinders 90, there being one such cylinder for each side of the carriage 44. As best seen in FIGS. 2, 5 and 7, and considering only the right hand cylinder 90, the latter is mounted on the frame bar 38 within the confines of the associated shield 42, and the cable 92 which is associated therewith has its ends secured in the usual manner to a piston 94 which is slidably disposed within the cylinder. The cable 92 passes around suitable pulleys 95 (FIGS. 1, 2 and 5) near the opposite ends of the cylinder and one end of the cable is fixedly secured to a bracket 96 which is carried by the adjacent slide bracket 72 while the other end of the cable is fixedly secured to the frame bar 38. It will be understood of course that the other cylinder 90 is similarly mounted on the frame bar 36 within the shield 40 and is similarly connected to the carriage 44 and such frame bar. In order to equalize the traveling motion of the carriage 44 in the longitudinal direction of the machine, racks 98 are disposed on the frame bars 36 and 38 and mesh with pinions 100 (FIG. 7) which are mounted on the opposite ends of an elongated shaft 102 which passes through the plates 74.

As clearly shown in FIGS. 1, 5 and 7, each pair of depending roller-supporting plates 80 serves to pivotally support therebetween a generally L-shaped jaw-like tire-supporting foot member 110 including a normally vertical section 112 and a normally horizontal section 114, the latter constituting, in effect, a tire-supporting shelf which functions momentarily each time the partially completed stack of tires T is raised by the two tire lifting forks to support such partially completed stack, as well as to support the completed stack at such time as the carriage 44 transfers the same from the stacking station 12 to the strapping station 14. Each foot member 110 is mounted for swinging movement about a horizontal axis between the full line tire-supporting position in which it is shown in FIG. 7 and the retracted dotted line position wherein the shelf portion 114 is withdrawn from the stack. The swinging movements of the foot members 100 are controlled by means of respective cylinder and plunger devices 116 which are connected between lugs 118 which are affixed to the plates 72 and lugs 120 which are affixed to the foot members 110.

Although in the illustrated embodiment of the invention, the stacking instrumentalities which have heretofore been described in considerably detail have been shown as being operatively associated with a set of yet-to-be-described strapping instrumentalities at the strapping station 14, it is contemplated that such stacking instrumentalities may be manufactured and sold independently of the strappng instrumentalities and that after a given group of tires has been up-stacked as previously explained, and the stacked tires shifted rearwardly from the stacking station 12, other strapping means than that illustrated herein at the strapping station 14 may be used to bind the tires in the stack. Therefore, before the nature of the strapping devices at the strapping station 14 is set forth herein, a description of the operation of the heretofore mentioned stacking devices will be rendered.

In the operation of the stacking instrumentalities at the stacking station 12, as soon as a tire is placed on the live rolls 20 (FIG. 1) it is immediately conducted rearwardly and into the stacking station 12. As the tire initially enters the stacking station, it encounters a pair of laterally adjustable centering posts or pins 122 (See also FIGS. 2 and 3) which are spaced apart a distance slightly greater than the overall diameter of the tires which are to undergo stacking. After passing between the centering posts 122, the tire then encounters a second pair of spaced apart pins 124, either or both of which may function to actuate a limit switch which, by means of appropriate circuitry, may initiate energization of the lift-cylinder 56 (FIG. 7), thus causing the vertically shiftable sleevelike slide member 50 to move upwardly on the fixed center post 54, thereby causing the two tire-lifting forks 46 to move upwardly to the raised positions in which they are shown in FIGS. 3 and 8 and in dotted lines in FIG. 7. Such upward movement of the lift forks 46 raises the tire which is supported thereon to a stackup level slightly higher than the normal horizontal level of the tire-supporting shelf 114 of the pivoted foot member 110. However, immediately prior to movement of the tire to such elevated stackup level, the cylinders 116 are actuated in such a manner as to retract the foot members 110 so that they will not interfere with the upward movement of the tire. As soon as the tire reaches the uppermost level of which it is capable of being moved by the lift forks 46, the cylinders 116 are caused to retract, thereby restoring the foot members 110 to their normal positions wherein the shelf portions or sections 114 underlie the peripheral edges of the tire which has thus been raised.

As soon as the foot members 110 resume their normal tire-supporting positions, the cylinder 56 is actuated to lower the slide member 50 on the centerpost 54, thus restoring the two lift forks 46 to their lower positions ready to receive the next succeeding tire which issues from the live rolls 20. This second tire enters the strapping station 12 in the same manner as the first tire and it is similarly treated by the centering pins 122 and limit switch actuating pins 124, as well as by the lift forks 46 and foot members 110. Since these latter members 110 move to their retracted positions at such time as the upper rim region of the second tire approaches them, the first tire in the stack is released by such foot members so that it drops by gravity a small fraction of an inch and comes to rest on the now supported second tire, and further upward motion of the fork members 46 carries both tires above the normal level of the shelf portions 114, after which the cylinders 116 are caused to restore the foot members to their inner or normal tire supporting positions. At this time in the stacking cycle, two of the tires T have been up-stacked and both of them are supported on the shelf portions 114 of the foot members 110, awaiting arrival of the third tire in the stacking station 12 from the live rolls 20. The operation is repetitious until all of the predetermined number of tires have been up-stacked as indicated by the dotted line disclosure of FIG. 3.

It is to be noted at this point that during the up-stacking operation as previously described, and as best seen in FIG. 7, the two lowermost rollers 82 on each of the plates 80 serve to guide or center the upwardly shifting tires toward the central axis of the stack while the four uppermost rollers on each such plate 80 serve to maintain the tires in their centered relationship. It is also be to noted that the various rollers 82 exert little if any inward pressure on the tires in the stack and, furthermore, it is not necessary that such rollers actually engage the periphery of the tires during the up-stacking operation inasmuch as the progressively increasing weight which is applied to the stack as each fresh tire enters the stacking station 12 and is up-stacked into position creates a slight amount of circumferential expansion of the tires, particularly those near the bottom regions of the stack.

After the last tire has been thus introduced into the stack at the bottom thereof, means are effected whereby the entire tire-clamping carriage 44 is caused to shift bodily rearwardly toward the strapping station 14 with the cylinder 84 still maintaining the carriage in its collapsed tire-clamping position. As previously described, this means is initiated by actuating the cable cylinders 90 so as to move the pistons 94 associated therewith in a direction which will cause the cable 92 to pull the carriage 44 rearwardly to the position wherein it is disclosed in FIG. 2. As seen as the carriage 44 reaches the limit of its rearward travel, the cylinder 84 is actuated so as to extend the same and thus force the two plates 72 apart, thus shifting the clamp bars 70, plates 80 and rollers 82 away from the stack of tires, thereby releasing the stack so that it falls by gravity upon a turntable 150 which is associated with the strapping station and the nature and function of which will be described in detail presently. If no strapping is provided as previously indicated, discharge of the stack of tires may be effected upon a suitable discharge conveyor, table or the like for remote strapping if desired.

Considering now the nature of the strapping instrumentalities at the strapping station 14 and by means of which the tire stacks which are delivered to such station from the stacking station 12, and referring particularly to FIGS. 1, 6 and 8, the strapping station involves in its general organization a pair of elongated vertically extending supporting posts 152 and 154 project upwardly from the deck plate 16 at diagonally disposed regions and the upper ends of such posts are connected together by a horizontal channel member 156 having a centrally disposed opening 158 formed therein. The diagonal disposition of the posts 152 and 154 is resorted to merely for space convenience or conservation on the deck plate. Supported in cantilever from the post 154 (see also FIGS. 2 and 4) is a rectangular platen-carrying frame 160 which is vertically shiftable on the post 154 by means of a rectangular guide tube or sleeve 162 which, like the aforementioned sleeve 50 of FIG. 7, is provided with internal rollers (not shown) similar to the rollers 52 and which roll tractionally on the post 154. The guide sleeve 162 is secured to the proximate end of the frame 160 while the distal end of the latter is guided in a vertical slot 164 which is established by the provision of a vertical channel 166 which is fastened to post 152 (FIGS. 6 and 8). The guide sleeve 50 is adapted to be actuated by means of a cylinder and plunger device 168 which extends between the deck plate 16 and a bracket 170 at one end of the channel member 156.

Centrally disposed on the underneath side of the frame 160 in the central region thereof is a platen assembly 172 consisting of a split circular roller-supporting disk or plate 174, the underneath side of which serves to support a series of radially extending rollers 176 (see particularly FIG. 8), such rollers being designed for engagement with the upper side of the uppermost tire T in the completed stack of tires after the stack has been transferred from the strapping station 12 and deposited on the turntable 150 in the strapping station 14 as previously described.

The platen-disk or plate 174 is formed with a central opening 180 therethrough which remains at all times in vertical register with the opening 158 in the channel member 156 and a vertical strap guide chute section which, for convenience, will hereinafter be referred to as the strap guide bayonet 182 is vertically shiftable through both openings 158 and 180 and is movable between the raised inoperative position wherein it is shown in FIGS. 1 and 4 to the lowered operative position wherein it is shown in FIGS. 2, 6 and 8 for purposes that will be made clear presently.

The vertical movements of the strap guide section or bayonet are effected under the control of a cable cylinder 184 (FIGS. 1, 4 and 4a) which is fixedly secured to a vertical T-shaped post 186, the lower end of the post being secured to the horizontal channel 156. A forked bracket 188 on the upper end of the cylinder 184 carries a pulley 190 and a flexible cable 192 has one end secured to a piston (not shown) within the cylinder 184. passes over the pulley 190 and has its other end secured to the upper end of the aforementioned strap guide bayonet 182. Preferably, but not necessarily, the cylinder 184 is of the single-acting type and the force of gravity normally urges the bayonet 182 to its lowered position as shown in FIG. 8 wherein its lower end seats within a centrally disposed socket 194 (FIG. 5) which is provided in the turntable 150 as will be described in greater detail subsequently.

Considering now the nature of the aforementioned turntable 150, the latter is mounted on a rectangular wear plate 200 (FIG. 8) and is tractionally carried thereon by means of rollers 202 which depend from a circular base plate 204 which is provided with an upstanding peripheral polygonal rim flange 206, the latter serving to support a pair of spaced part roller-supporting mounting plates 208, each of which serves to support thereon a series of antifriction rollers 210. The rollers 210 are thus divided into two groups with the rollers of both groups extending in parallelism and in secant fashion across the turntable. The aforementioned bayonet-receiving socket which appears only in FIG. 5 is disposed between the two groups of rollers 210 and is in register with the central vertical axis of the turntable.

Means are provided for periodically indexing the turntable 150 alternately in opposite directions throughout an angle of 90°, such means consisting of a pair of indexing cylinders 212 on opposite sides of the turntable and which have their outer ends secured to mounting brackets 214 carried on the deck plate 16 and having their inner ends pivotally connected to the turntable at eccentric points thereon. It will be understood, of course, that the turntable is suitably supported for rotational movement about a fixed vertical axis although the bearing devices by means of which the turntable is maintained in co-axial relationship with respect to the bayonet 182 is not disclosed in the drawings.

Actual strapping operations on the stacked tires are carried out by means of a pair of opposed strapping heads, each of which has been designated in its entirety by the reference numeral 214 (see particularly FIG. 6) the heads straddling the stack SK and being movable in unison in opposite directions between the operative strapping positions in which they are shown in FIGS. 3 and 6, and the remote inoperative or parked positions in which they are shown in FIGS. 1, 4 and 8. The strapping heads 214 are tractionally mounted on track mounts 216 (FIG. 3) for in and out movement toward and away from the stack S suitable roller trucks 218 having both vertical rollers 220 and horizontal rollers 222 being provided for this purpose. Piston and cylinder devices 224 extend between extensions 226 on the track mounts 216 and brackets 228 on the strapping heads 214 for effecting strapping head movements.

Various commercial strapping machines or heads having strap feeding, strap-tensioning, seal applying and strap severing instrumentalities associated therewith are available, with or without modification as desired, to accomplish the aims of the present invention, but the particular strapping head 214 selected for illustration herein is of the general type which is manufactured and sold by Signode Corporation of Glenview, Ill. under the trade designation Model MD310 and a full disclosure of which is made in U.S. Pat. No. 2,915,003, granted on Dec. 1, 1959, and entitled Power Strapping Machine. The entire disclosure of such patent, insofar as it is consistent with the present disclosure is hereby incorporated in and made a part of this application by reference thereto. In the present disclosure however, only such portions of the strapping head or machine as are pertinent to the present invention are disclosed, together with the necessary modifications.

As best shown in FIGS. 3 and 8, each strapping head 214 is supplied with strapping from a conventional strapping dispenser assembly 230 conveniently mounted adjacent to a rear corner of the deck plate 16, the strapping issuing from a roller 230, passing beneath a pulley 232 and from thence through a narrow accumulator 234 and into the strapping head proper. A pair of fixed angular strap chute sections 236 are suspended from the nunderneath side of the channel 156, such chute sections lying in a vertical transverse plane and thus being at a slight angular bias relative to the diagonally disposed channel. Each chute section 236 includes a vertical leg 238 and an inwardly extending horizontal leg 240, together with a short inclined connecting section 242. The horizontal legs 240 are coaxial and have their inner ends separated from each other by a short distance, and these opposed ends are adapted to become in operative register with a pair of adjacent inclined short chute sections 244 which are carried near the upper end of the bayonet 182 but which move into such register when the bayonet is lowered through the stack S of tires on the turntable 150 and assume its lowermost home position on such turntable.

As shown in FIGS. 6 and 8, the turntable carries two pairs of radially extending aligned chute sections 246 which, when the turntable is turned so that either pair of such chute sections extend transversely of the strapping station 14, cause such pair to register with a pair of fixed inclined chute sections 248. When the strapping heads 214 are disposed in their widely separated positions as shown in FIG. 8, the inclined chute sections 248 register with the strap accumulator 234. When thus turned, the radial chute sections 246 also register with the lower end region of the bayonet 182. As shown in FIGS. 4, 8 and elsewhere in the drawings, the bayonet 182 is of a sectional nature, adjacent chute sections 250 thereof registering with each other in end-to-end fashion.

From the above description it will be observed that when the strapping heads 214 are in their widely separated postions as shown in FIG. 8, but with the turntable 150 rotated through an angle of 90° with respect to its illustrated position, two strap guiding closed loop-forming paths are provided for passing strapping material through the eye of the stack and then around the outer sides of the stack at diametrically disposed regions. Each of these paths extend from the strap feeding outlet of the associated strapping head, upwardly through the adjacent vertical leg 238 of a chute section 236, inwardly through the horizontal leg 240, then through the associated short inclined chute section 244 and downwardly through the now lowered bayonet 182 and from thence laterally or radially outwardly of the turntable 150 through the chute section 240 to the inclined chute section 248 and thus through the accumulator 234 and back to the strapping head 214.

It will be understood that in accordance with conventional strapping chute practice, each chute section is provded with the usual spring-biased strap retaining gates 252 (FIG. 4*a*) on opposite sides thereof which normally maintain the strapping captured within such chute sections but which yield to release the strapping when the latter is tensioned by the strapping machine, portions of the thus released strapping S being disclosed in FIG. 6. A detailed example of such spring-biased strap chute gates is shown and described in U.S. Pat. No. 3,899,963, granted on Aug. 19, 1975, and entitled "Articulated Strap Chute and Guide Means thereof". It will also be understood that the sectional bayonet structure 182 is dual-sided, which is to say that it presents chute channels and associated gates which face outwardly away from each other or, in other words are arranged in tandem back-to-back relationship so that during the simultaneous operation of the two strapping heads 214, two lengths of the strapping material are fed downwardly through the eye of the stack and then outwardly as previously described through the radical strap chute sections 246 when the turntable is so oriented that such sections extend transversely of the strapping station and register with the inclined chute sections 248.

After the two strap loops which pass through the eye of the stack ST have been formed as previously described, the cylinders 212 (FIG. 3) are actuated to bring the two strapping heads 214 inwardly against the tire stack ST as shown in FIGS. 6 and 8, it being recalled that the turntable 150 at this time is disposed at an angle of 90° from its illustrated position. The strapping heads are then actuated to tension the strapping and, during such tensioning, the strapping S is forcibly pulled from the various chute sections as illustrated in FIG. 6 and thus pass through the split platen plate 174, between adjacent platen rollers 176, and are then shrunk upon the periphery of the stack to provide two closed strap loops which pass through the eye of the stack and are disposed in diametrically opposed relationship. Thereafter, the cylinders 212 are actuated to rotate the turntable 150 in a counterclockwise direction as viewed in FIG. 6 and the strapping heads 214 are again actuated to apply two additional strap loops to the stack at diametrically opposed regions which are removed from the first pair of strap loops by an angle of 90°, an example of such a completely strapped tire stack ST being illustrated in FIG. 3.

It is to be noted at this point that the particular strapping heads 214 which are disclosed herein for exemplary purposes and which are of the general type shown and described in the aforementioned U.S. Pat. No. 2,915,003, operate upon fusible thermoplastic strapping so as to establish the joint or seal between the overlapping portions of a strap loop by effecting interfacial rubbing of these portions, one against the other to develop a degree of friction-induced heat sufficient to fuse the interfacial contacting surfaces and cause them to blend together so that after the friction-producing operation has been terminated, solidification takes place and a weld or seal is produced. For tire stack strapping purposes the use of plastic strapping in this manner possesses numerous advantages, principal among which are the adaptation of the relatively flexible plastic material to the soft rubber of the tires, and the elimination of metal seals which require special seal-handling devices such as seal magazines and power-actuated crimping jaws. It is to be distinctly understood however that the invention is not limited to the use of friction fusion for effecting the overlap seal joints and, if desired, other forms of strapping heads having seal applying and crimping facilities may be employed if desired.

Referring now to FIGS. 2, 3, 4 and 5 will reveal the fact that the rear ends of the two clamp bars 70 are formed with inturned flanges 260 which function at such time as each completely stacked, but yet unstrapped, stack ST of tires is carried rearwardly for deposition upon the turntable 150 at the strapping station, to engage a previously strapped stack such as the stack which is shown on the turntable in FIG. 3 and force the same bodily as a unit from the turntable and onto a suitable discharge conveyor or the like such as that shown at 262 in FIG. 2.

A suitable control panel (not shown) may be set up alongside the machine 10, such panel serving the instrumentalities at both the stacking station 12 and the strapping station 14 in such a manner that continuous and repetitious machine operation is effected, the stacking devices operating to create a stack ST of tires during the time that the strapping devices operate to strap a previously stacked group of tires.

The invention is not to be limited to the exact arrangement of parts shown in the accompanying drawings or described in this specification as various changes in the details of construction may be resorted to without departing from the spirit of the invention. For example, insofar as the stacking instrumentalities at the strapping station 12 are concerned, such instrumentalities are not nencessarily limited to use in connection with the stacking of automotive tires inasmuch as, bu suitable modification, if desired, the same or similar stacking devices may be employed for the upstacking of a wide variety of other articles, whether the same be of annular configuration or otherwise. Among such articles which are capable of being stacked by utilizing the basic principles of the invention are various packagelike devices such as boxes, crates and other containers. Therefore, only insofar as the invention has particularly been pointed out in the accompanying claims is the same to be limited.

Having thus described my invention, what I claim and desire to secure by letters patent is:

1. In an article stacking and strapping machine, in combination, a machine framework establishing a forward stacking station and a rearward strapping station, means at said stacking station defining a support adapted to receive successive articles thereon, a vertically shiftable lift member movable between a lower position wherein it underlies an article or said support and a raised position wherein it engages and elevates such article to a stacking level, means for actuating said lift member, a pair of opposed article-supporting foot members movable in unison toward and away from each other substantially at said stacking level between inner positions wherein they engage and underlie the peripheral regions of the lowermost article in a stack at said stacking level and serve to support the same, and outer positions wherein they release such article, means for moving said foot members, means effective when said lift member and foot members have thus upstacked a predetermined number of articles at the stacking station for shifting said foot members, and consequently the stack of articles supported thereby, rearwardly to the strapping station, and for thereafter moving said foot members to outer positions to release the stack and thus deposit the same in the strapping station, and means at said strapping station for applying binding straps vertically to the thus deposited stack.

2. In an article stacking and strapping machine, the combination set forth in claim 1, wherein said framework embodies an upstanding post, a sleeve-like slide member is movable vertically on said post, said lift member comprises a lift fork having a pair of tire-engaging fork tines which are supported in cantilever from said slide member, and the means for actuating the lift member comprises a cylinder and plunger device connected at its opposite ends to said sleeve and a fixed portion of the framework.

3. In an article stacking and strapping machine, the combination set forth in claim 2, wherein said article support is in the form of a series of transverse rollers, and the lift fork tines extend parallel to said rollers, and each fork tine passes between the adjacent rollers during movement of the lift fork between its lower and its raised position.

4. In an article stacking and strapping machine, the combination set forth in claim 3, wherein said framework embodies a pair of longitudinally extending guideways on opposite sides of the stacking station, a clamping carriage is slidable in said guideways between the stacking station and the strapping station, and the article-supporting foot members are pivoted to said carriage for swinging movement in unison about respective horizontal axes toward and away from each other and embody shelf-like sections which project beneath the tires which are brought to stacking level in supporting relationship by said lift fork.

5. In an article stacking and strapping machine, the combination set forth in claim 4, wherein said clamping carriage is generally of U-shape configuration and embodies a transverse guide bar having slide brackets disposed on its opposite end regions for sliding movement toward and away from each other, rearwardly projecting clamp bars fixedly secured at their proximate end to said slide brackets respectively and extending rearwardly in cantilever fashion therefrom, and a series of vertically spaced stack-guiding rollers supported on each clamp bar, the article-supporting foot members are effectively supported from the clamp bars, and means are provided for shifting said slide brackets, and consequently the clamp bars and rollers, toward and away from each other.

6. In an article stacking and strapping machine, the combination set forth in claim 5, wherein said clamp bars are provided with lateral abutments on their rear distal ends designed for engagement with a previously strapped stack of articles at the strapping station to push the same forcibly from such station at such time as the carriage conducts an unstrapped stack of articles to the latter station.

7. In an automotive tire stacking and strapping machine, in combination, a machine framework establishing a forward stacking station and a rearward strapping station, means at said stacking station defining a tire support adapted to receive successive tires thereon in a horizontal position, a vertically shiftable lift member movable between a lower position wherein it underlies a tire on said support and a raised position wherein it engages and elevates such tire to a stacking level for upstacking purposes, means for actuating said lift member, a pair of opposed stack guiding and supporting assemblies movable in unison toward and away from each other substantially at said stacking level between inner positions wherein they define a stack guide and also engage and underlie the peripheral regions of the lowermost tire at said seacking level and serve to support the same, and outer positions wherein they release such tire, means for moving said assemblies, means effective when said lift member and assemblies have thus stacked a predetermined number of tires at the stacking station for shifting said assemblies, and consequently the stack of tires supported thereby, rearwardly to the strapping station, and for thereafter moving said assemblies to their outer positions to release the stack and thus deposit the same in the strapping station, and means at said strapping station for applying a series of binding straps through the stack and around the generally cylindrical rim region thereof to draw the peripheral regions of adjacent tires together in contiguity.

8. In an automotive tire stacking and strapping machine, the combination set forth in claim 7. wherein each of said stack guiding and tire supporting assemblies embodies a series of vertically spaced guide rollers which, when such assemblies are in their inner positions, in combination with each other define a stack centering guide path within which successive tires are upstacked, a laterally shiftable foot member which, when the assemblies are in their inner positions, is movable between a projected position wherein it underlies the adjacent peripheral portion of a tire at said stacking level, and a retracted position wherein it releases said tire, and means for shifting said foot members between their projected and their retracted positions.

9. In an automotive tire stacking and strapping machine, the combination set forth in claim 8, wherein each foot member is generally of L-shape configuration and includes a normally vertical section and a normally horizontal section of shelf-like form and adapted for projection beneath the peripheral portion of said lowermost tire.

10. In a machine for strapping a vertical stack of superimposed coaxial horizontally disposed tires, a machine framework establishing a strapping station, a stack support at said strapping station and adapted for centered relationship thereon of successive stacks of tires, a pair of strapping heads on opposite sides of the support and movable toward and away from each other between inner positions wherein they engage the stack and remote outer positions, means for moving said heads in unison, a pair of upper fixed strap chute sections, one for each head, each section being effective when its associated strapping head is in its outer position to conduct strapping upwardly and inwardly from such head to a region in vertical register with the eye of the tire stack on the support, a pair of vertical strap chute sections, one for each head, movable vertically and axially between a lower position wherein it projects completely through the eye of the stack and the upper end thereof registers with an associated fixed strap chute section while the lower end thereof is disposed adjacent to said support, and an upper position wherein it is withdrawn from the stack, means for moving said vertical strap chute sections, a pair of radially extending aligned strap chute sections on said support, one for each strapping head, having its inner end adapted for register with the associated vertical strap chute section when the latter is in its lower position, and a second pair of fixed strap chute sections, one for each strapping head, each of said latter sections having its inner end in register with the outer end of the associated radial strap chute section and adapted, when the associated strapping head is in its inner position to conduct strapping thereto from said radial strap chute section, the strap chute sections associated with each strapping head serving to conduct strapping endwise from such head downwardly through the stack and back to the head to provide a closed loop which, upon tensioning thereof, becomes shrunk upon the generally cylindrical wall of the stack to draw adjacent tires in the stack together.

11. In a machine for strapping a vertical stack of superimposed coaxially horizontally disposed tires as set forth in claim 10, wherein said stack support is in the form of a rotatable turntable having a second pair of radially extending aligned strap chute sections which extend at an angle of 90° to said other pair of radially aligned sections, and means are provided for indexing said turntable throughout an angle of 90° whereby, after the pair of strapping heads on opposite sides of the turntable have applied tensioned loops to the stack of tires, the strapping operation may be repeated to apply additional strapping loops to such stack at circumferentially spaced regions removed from the initially applied loops by 90°.

* * * * *